United States Patent [19]

Ecker et al.

[11] 4,365,429

[45] Dec. 28, 1982

[54] MAXIMUM LIFT SYSTEM FOR HYDRAULIC HOE

[75] Inventors: Frank A. Ecker, Racine; Theodore G. Jensen, Kenosha; Norman B. Christensen, Racine, all of Wis.

[73] Assignee: Bucyrus-Erie Company, South Milwaukee, Wis.

[21] Appl. No.: 322,404

[22] Filed: Nov. 18, 1981

[51] Int. Cl.[3] ..... E02F 3/32; F15B 13/08

[52] U.S. Cl. ..... 37/103; 37/DIG. 9; 414/685; 137/596.14; 137/625.63

[58] Field of Search ..... 37/103, DIG. 1, DIG. 7, 37/DIG. 9, 117.5; 414/699, 685; 137/561 R, 624.27, 625.63, 625.6, 596.13, 596.14

[56] References Cited

U.S. PATENT DOCUMENTS

| | | | |
|---|---|---|---|
| 2,969,844 | 1/1961 | Hamrick | 175/130 |
| 3,324,881 | 6/1967 | Keir | 137/596.13 |
| 3,583,585 | 6/1971 | Joyce | 37/103 X |
| 3,584,751 | 6/1971 | Bellart | 37/103 X |
| 3,606,049 | 9/1971 | Gordon | 37/103 X |
| 3,865,013 | 2/1975 | Mastaj | 37/103 X |
| 3,874,532 | 4/1975 | Metailler | 37/103 X |
| 3,883,023 | 5/1975 | Bernhoft | 137/625.63 X |
| 3,922,745 | 12/1975 | Lehman | 15/87 |
| 3,927,603 | 12/1975 | Bernhoft | 137/596.14 X |
| 3,934,742 | 1/1976 | Tennis | 137/596.12 X |
| 4,044,610 | 8/1977 | Oldaeus et al. | 37/DIG. 19 |
| 4,218,837 | 8/1980 | Peterman | 37/103 |
| 4,288,196 | 9/1981 | Sutton | 37/103 X |

FOREIGN PATENT DOCUMENTS

| | | | |
|---|---|---|---|
| 885292 | 11/1971 | Canada | 37/103 |
| 1403046 | 8/1975 | United Kingdom | 414/699 |

*Primary Examiner*—E. H. Eickholt
*Attorney, Agent, or Firm*—Quarles & Brady

[57] ABSTRACT

A maximum lift system for a hydraulic hoe includes a dual pressure relief valve in the hoist circuit and an actuating valve that delivers a signal to the relief valve to increase hoist capacity and simultaneously causes operation of lockout valves to center the wrist control valve and thus lock the dipper in position.

4 Claims, 4 Drawing Figures

MAXIMUM LIFT SYSTEM FOR HYDRAULIC HOE

BACKGROUND OF THE INVENTION

Hydraulic hoes are generally designed with a normal hoist capacity that is less than the possible maximum and is selected to balance such factors as efficiency and machine life. In some cases, for example where the operator desires to use the machine to lift a section of pipe or other load or to lift an overhanging slab, it is desirable to be able to hoist at or near actual maximum capacity. It is important, however, to prevent the machine from being used continuously in such a maximum hoist or lift mode, to avoid defeating the design objectives.

One way of increasing hoist capacity is to provide a dual pressure relief valve in the hoist circuit. A biasing signal is applied when the machine is to be used in maximum lift mode, thus effectively increasing the relief setting to allow increased hoist pressure and capacity. Preventing continuous use in this mode can be accomplished by simultaneously disabling the wrist function so the machine cannot be used for normal digging. A system incorporating this general approach is shown in U.S. Pat. No. 4,218,837, issued Aug. 26, 1980, but that system is not believed fully satisfactory. For one thing, it utilizes a second dual pressure relief valve in the wrist circuit to disable the wrist function, and the system can apparently be used only when the dipper is in a selected position.

SUMMARY OF THE INVENTION

The system of this invention utilizes a dual pressure hoist relief valve with means to disable the wrist function, but provides important improvements. One is that the wrist function is disabled by effectively locking the dipper in position so there can be no undesired movement and the maximum lift mode can be used with the dipper in any position. In the preferred embodiment, wrist disablement is accomplished using a highly effective but simple lockout arrangement triggered by the same actuating valve that supplies the bias signal to the relief valve. The preferred embodiment uses a main relief valve as the dual pressure valve, as opposed to using port relief valves that are not as readily adaptable to this sort of operation.

The system of the invention is highly effective and reliable, while being simple, inexpensive and easy to manufacture, assemble, use and maintain. It is readily adapted for retrofitting. These and other objects and advantages will be apparent from the description to follow.

DESCRIPTION OF THE PREFERRED EMBODIMENTS

Figure 1:
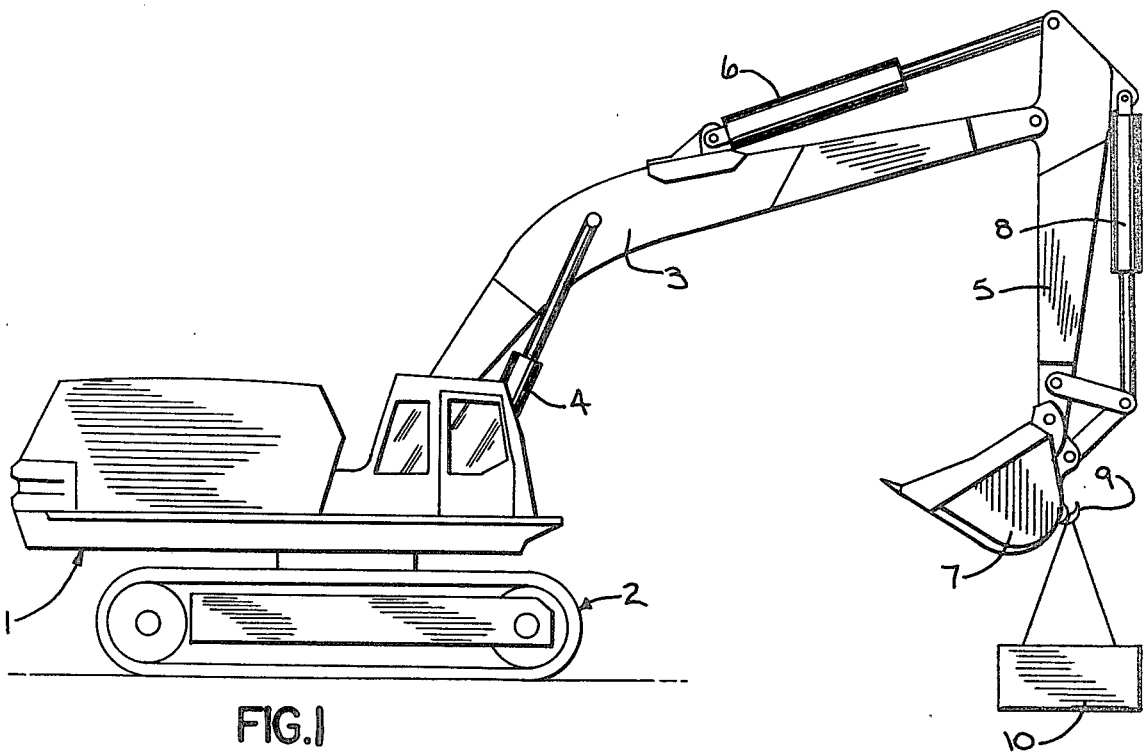
FIG. 1 is a schematic view of a hydraulic hoe incorporating a system constituting a preferred embodiment of the invention.

Except for the maximum lift system to be described, the hoe shown in FIG. 1 is conventional. It includes a working platform 1 revolvably mounted on a crawler base 2. A boom 3 is footed on the platform 1, and is raised and lowered by a double acting hydraulic hoist cylinder 4 (only a single hoist cylinder is shown, but it will be obvious to those skilled in the art that the invention can readily be used with the more conventional dual hoist cylinder arrangement). A stick 5 is pivotably mounted at the end of the boom 3, and is actuated by a double acting hydraulic dig cylinder 6. A dipper 7 is pivoted at the end of the stick 5, and is actuated in a wrist or curling action by a double acting hydraulic wrist cylinder 8. As is conventional, the dipper 7 is provided with a load hook 9 that can be used for lifting pipe or other loads, a load 10 being shown suspended from the hook 9.

Figure 2:
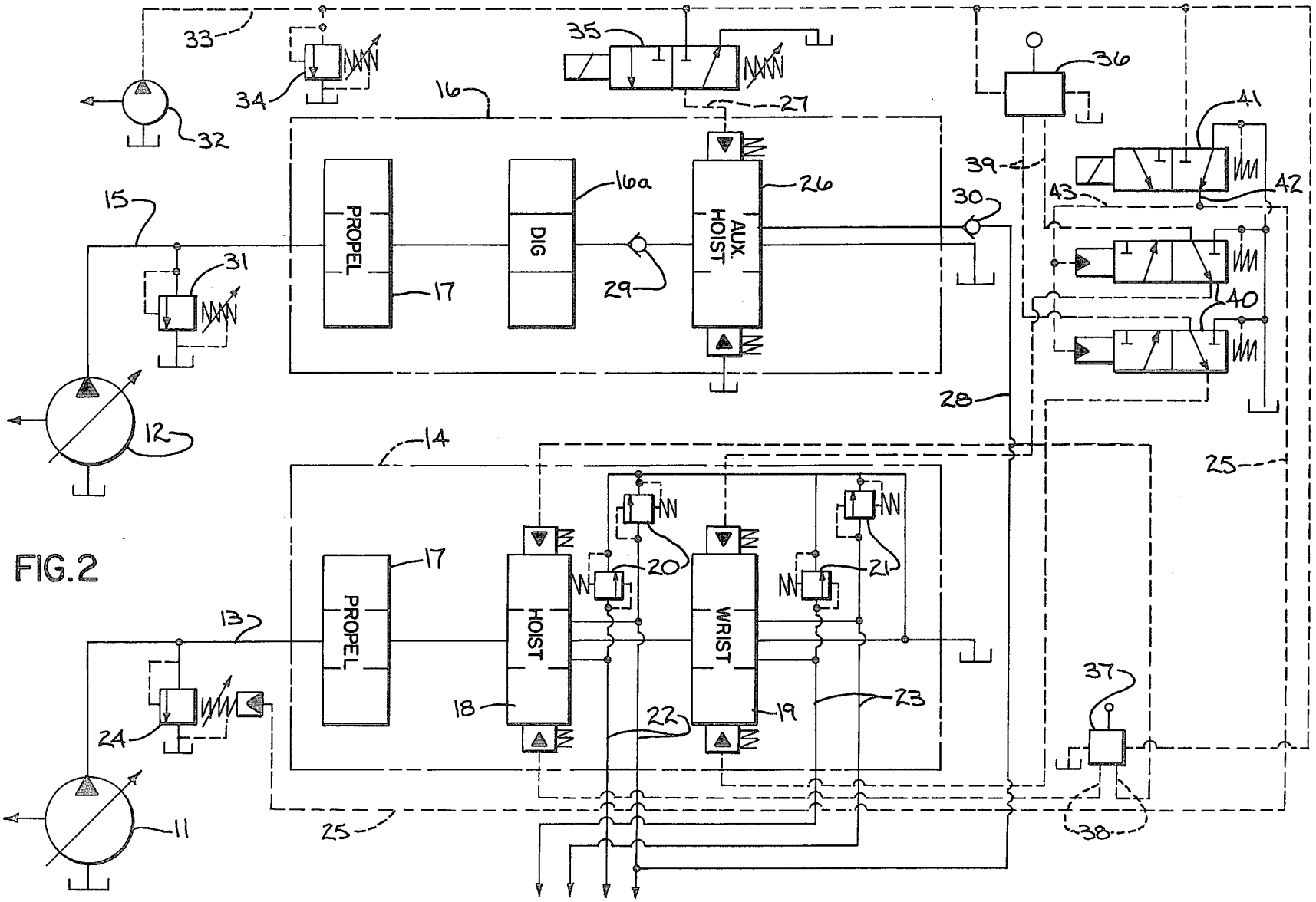
FIG. 2 is a schematic hydraulic circuit diagram showing the maximum lift system for the machine of FIG. 1.

FIG. 2 shows the overall hydraulic circuit for the machine, but it will be obvious that various conventional components that do not relate directly to the invention have been shown only schematically or omitted. Those skilled in the art are well aware of the general nature and possible components for such circuits, and will be able to practice the invention based on the showing and description herein.

The preferred embodiment utilizes a dual propel system including separate main pumps, each of which provides pressurized fluid for a respective crawler track and for certain other functions. Thus, there are main pumps 11 and 12, both preferably driven by the same engine or other prime mover (not shown). The main pump 11 delivers fluid through a main line 13 to a first valve block 14, and the pump 12 delivers fluid through a main line 15 to a second valve block 16. The valve blocks 14, 16 each include a conventional three-position propel valve 17 connected to a respective track, and the valve block 16 also includes a conventional three-position dig valve **16*a* connected to and controlling the dig cylinder 6**. The connections for these valves have not been shown since they are well known and do not play any part in the invention.

The valve block 14 also includes a hoist valve 18 and a wrist valve 19, both of which are three-position, spring centered, pilot operated valves. The hoist valve 18 has conventional port relief valves 20, and the wrist valve 19 has similar port relief valves 21. The port relief valves 20, 21 are pre-set at relatively high pressures, approximately 5,250 psi for the hoist port relief valves 20 in the preferred embodiment. The hoist valve 18 controls hoist cylinder lines 22 leading to the opposite ends of the hoist cylinder 4, and the wrist valve 19 controls wrist cylinder lines 23 leading to the opposite ends of the wrist cylinder 8. A main relief valve 24 is in the main line 13, and it is a dual pressure relief valve of any suitable known type. It has a normal, relatively low setting, which is approximately 4,500 psi in the preferred embodiment. It can, however, be raised to a higher or maximum setting by the application of a pilot pressure or bias signal through a signal line 25. In the preferred embodiment, the bias signal pressure is such as to raise the setting of the valve 24 to approximately 5,000 psi, which is still less than the settings of the port relief valves 20. Assuming the machine is hoisting, this significantly increases the available hoist pressure, and therefore hoist capacity. In the preferred embodiment, assuming a 20 foot radius and 20 foot height, the lift or hoist capacity is approximately 35,400 pounds at the normal setting of the relief valve 24, and is raised to approximately 47,350 pounds at the maximum setting.

The valve bank 16 also includes an auxiliary hoist valve 26 that operates as a two-position valve. It is normally spring centered to an inactive position, but can be operated to an activated position by application of a pilot signal through a pilot line 27. When the valve 26 is activated, pressurized fluid is delivered through an auxiliary hoist line 28 that joins the line 22 that is on the raise side of the hoist cylinder 4, this providing for increased hoist speed in known fashion. As is conventional, the valve 26 includes a load check valve 29 to prevent fluid from flowing back through the valve 26 in the event of an overload, and there is an auxiliary check valve 30 that also prevents back flow and leakage that might cause drifting. There is a second main relief valve 31 in the line 15, but this is a conventional signal pressure valve that is set approximately the same as the normal setting of the valve 24, and one effect of this is that activation of the valve 26 does not provide additional pressure and resulting hoist capacity.

A control circuit includes a control pump 32 that is preferably a separate pump driven from the same prime mover as the pumps 11 and 12 and that directs control pressure into a main control line 33. A single pressure control relief valve 34 in line 33 maintains control pressure at approximately 550 psi in the preferred embodiment. The control line 33 leads to an auxiliary hoist control valve 35 that is normally closed and solenoid operated. When operated, the valve 35 directs control pressure to the auxiliary hoist valve 26 to activate it.

The control line 33 also leads to a manual wrist control 36 and a manual hoist control 37, which are shown as separate but can be incorporated in a single joystick control if desired. Hoist control output lines 38 from the hoist control 37 lead to the opposite ends of the hoist valve 18 to allow the operator to control that valve and function. Wrist control output lines 39 from the wrist control 36 similarly ultimately lead to the opposite ends of the wrist valve 19 to allow the operator to control that valve and function, but the lines 39 first pass through a lockout means in the form of two lockout valves 40, each line 39 passing through a respective lockout valve 40. The two valves 40 are the same, each being a two-position valve that is normally spring-biased to the open position shown wherein the associated line 39 effectively passes through the valve to a respective end of the wrist cylinder 19. The valves 40 can, however, be selectively operated by being pilot actuated to closed positions wherein both lines 39 are blocked.

The control line 33 also leads to an actuating means in the form of an actuating valve 41. This is a two-position valve that is normally spring biased to the closed position shown. It can, however, be solenoid actuated to an open position wherein control pressure passes to an actuating line 42 that has two branches. One branch 43 leads to both lockout valves 40, and the presence of control pressure in this branch will cause both valves 40 to operate or close. The other branch is the pilot line 25 referred to above that leads to the relief valve 24, and pressure in this line provides the bias signal to cause simultaneous raising of the setting of the valve 24.

Figure 3:
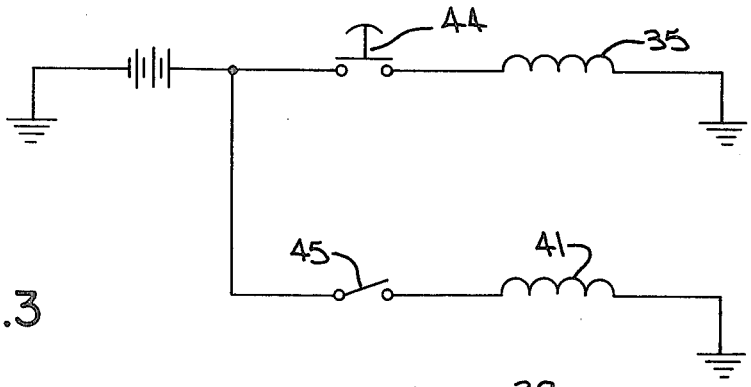
FIG. 3 is a schematic electrical circuit diagram showing the switching arrangement for the circuit of FIG. 2.

The valves 35 and 41 are operated through the electrical circuit shown very schematically in FIG. 3. A push button switch 44 provides for momentary actuation of the valve 35, and a switch 45 provides for actuation of the valve 41.

During normal operation, the entire system pressure, including the hoist function, is controlled by the setting of the relief valve 31 and the normal, lower setting of the relief valve 24, which settings are substantially the same. In this situation, the valves 35 and 41 are closed as shown, and the valves 40 are open as shown to provide for normal hoist and wrist control. The operator may at any time activate the auxiliary hoist valve 35. When the operator desires to go to maximum lift mode, the switch 45 is closed to operate the valve 41. This causes the bias signal to be delivered through the line 25 to raise the setting of the relief valve 24 to its maximum, and simultaneously operates the valves 40 by closing them, which also closes lines 39. Closing the lines 39 effectively closes or blocks the wrist circuit and allows the wrist valve 19 to center, which means that the wrist cylinder 8 and dipper 7 will be locked in whatever position they are in at the time. The operator is thus provided with increased hoist capacity, but cannot accomplish normal digging operations while the maximum lift system is in use. It is a particular advantage of the system that the dipper 7 may be locked in any position so that it is not subject to unexpected movement and can be used for various possible purposes.

When the machine is in maximum lift mode, the check valves 29 and 30 prevent the increased hoist pressure from feeding back beyond the auxiliary hoist valve 26. If such check valves are not present, it may be necessary to provide an electrical interlock, for example by modifying the circuit shown in FIG. 3, to prevent activation of the maximum lift mode while the auxiliary hoist function is being used, or vice versa.

Figure 4:
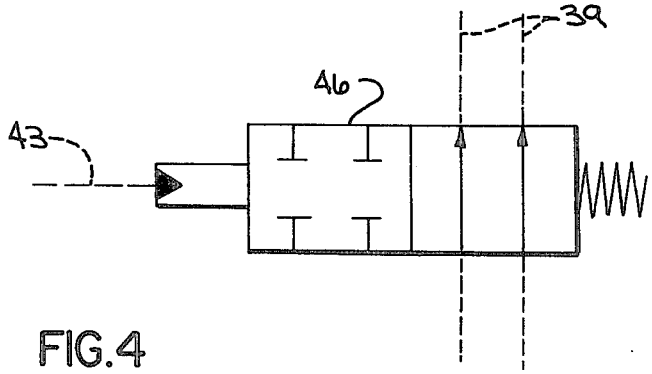
FIG. 4 is a fragmentary schematic hydraulic circuit diagram illustrating another form of lockout means for the wrist action.

While the use of the two lockout valves 40 is preferred from the standpoint of efficiency and being able to use inexpensive standard components, a lockout means comprising a single lockout valve could be substituted as shown by FIG. 4. FIG. 4 shows a single lockout valve 46 that is in both wrist output lines 39. It is normally spring set to the open position shown, but can be pilot operated, and this would be done through the line 43 as the circuit is shown in FIG. 2.

The invention provides for use of the machine in a maximum lift mode, while preventing misuse by effectively locking the wrist cylinder in position. This is accomplished efficiently and yet simply and inexpensively. Conventional components are used, which makes it easy to retrofit existing machines to incorporate the system of the invention. While the preferred embodiments shown and described provide these and other noted advantages, it will be obvious that various modifications might be made without departure from the spirit of the invention. The dual pressure relief valve could, for example, be put elsewhere in the hoist circuit, such as by replacing the port relief valve 20 that is on the raise side; but it is a particular advantage of the preferred embodiment that a main relief valve is used. Equivalent lockout means could also be substituted. In view of these and other possible modifications, the invention is not intended to be limited by the showing or description herein, or in any other manner, except insofar as may specifically be required.

We claim:

1. In a maximum lift system for a hydraulic hoe having a hydraulic hoist cylinder and associated hoist circuit, a double-acting hydraulic wrist cylinder with an associated wrist circuit, a dual pressure relief valve in the hoist circuit that has a normal lower operating setting and can be hydraulically biased to a higher maximum setting, and actuating means to supply a bias signal to the relief valve, the improvement wherein: there is a lockout means in the wrist circuit that is selectively operable to block the wrist circuit and lock the wrist cylinder in whatever position it is then in; and the actuating means operates the lockout means simultaneously with supplying the bias signal.

2. The system of claim 1, and in which the wrist circuit includes a three-position pilot operated valve with wrist control lines leading to opposite sides thereof, wherein: the lockout means comprises two lockout valves, one in each wrist control line, each lockout valve being normally open, the actuating means serving to simultaneously close both lockout valves.

3. The system of claim 2, and in which there is a three-position pilot operated control valve for the hoist cylinder, manual controls for the hoist and wrist valves, and a hydraulic control circuit for both the hoist and wrist valves, wherein: the lockout valves are hydraulically pilotable to closed positions; and the actuating valve is a normally closed valve connected to the control circuit that, when opened, simultaneously delivers the bias signal to the relief valve and pilots the lockout valves to closed positions.

4. A system according to claim 3, and in which there is a main pump with a main fluid line leading to the hoist valve, wherein: the relief valve is in said main fluid line.

* * * * *

UNITED STATES PATENT AND TRADEMARK OFFICE

CERTIFICATE OF CORRECTION

PATENT NO. : 4,365,429

DATED : December 28, 1982

INVENTOR(S) : Frank A. Ecker et al.

It is certified that error appears in the above—identified patent and that said Letters Patent is hereby corrected as shown below:

Col. 3, line 19, "signal" should read -- single --.

Signed and Sealed this

*Twenty-second* Day of *March 1983*

[SEAL]

*Attest:*

GERALD J. MOSSINGHOFF

*Attesting Officer*

*Commissioner of Patents and Trademarks*